United States Patent [19]

Sema

[11] Patent Number: 4,703,701

[45] Date of Patent: Nov. 3, 1987

[54] DESK WITH HEIGHT AND ANGLE ADJUSTABLE TABLE TOP

[75] Inventor: Teruji Sema, Tokyo, Japan

[73] Assignee: Inaba Seisakusho Ltd., Tokyo, Japan

[21] Appl. No.: 852,687

[22] Filed: Apr. 16, 1986

[30] Foreign Application Priority Data

Apr. 19, 1985 [JP] Japan ..... 60-57548
Sep. 11, 1985 [JP] Japan ..... 60-138137

[51] Int. Cl.[4] ..... A47S 5/12; A47B 11/00

[52] U.S. Cl. ..... 108/10; 108/138; 108/147

[58] Field of Search ..... 108/10, 9, 7, 6, 2, 108/1, 138, 144, 146, 106, 147; 248/420, 398

[56] References Cited

U.S. PATENT DOCUMENTS

| | | | |
|---|---|---|---|
| Re. 25,376 | 4/1963 | Freeman | 108/10 |
| 740,120 | 9/1903 | Graefe | 108/144 |
| 1,726,786 | 9/1979 | Whitney | 108/2 X |
| 2,892,486 | 6/1959 | Herring et al. | 248/420 |
| 3,089,275 | 5/1963 | Alabor . | |
| 3,232,248 | 2/1966 | Gelb . . | |
| 3,304,892 | 2/1967 | Bengtson | 108/144 X |
| 3,358,620 | 12/1967 | Parigi | 108/144 X |
| 3,543,282 | 11/1970 | Sautereau | 108/144 |
| 3,640,228 | 2/1972 | Busse | 108/10 X |
| 3,958,657 | 5/1976 | Selman | 312/327 X |
| 4,026,222 | 5/1977 | Mueller | 108/146 |
| 4,180,002 | 12/1979 | Huempfner | 108/6 |
| 4,231,297 | 11/1980 | Holbek | 108/10 |
| 4,248,161 | 2/1981 | Adair et al. | 108/6 |
| 4,360,180 | 11/1982 | Bruneau | 108/146 X |
| 4,397,295 | 8/1983 | Washburn | 108/9 X |
| 4,404,914 | 9/1983 | Taylor | 108/9 |
| 4,474,115 | 10/1984 | Carlton | 108/7 |
| 4,566,741 | 1/1986 | Eriksson et al. | 108/10 X |

FOREIGN PATENT DOCUMENTS

| | | |
|---|---|---|
| 1073762 | 9/1954 | France . |
| 2350812 | 12/1977 | France . |

*Primary Examiner*—Kenneth J. Dorner
*Assistant Examiner*—José V. Chen
*Attorney, Agent, or Firm*—Frank J. Jordan; C. Bruce Hamburg; Manabu Kanesaka

[57] ABSTRACT

Metal desk which includes a table top, triangular guide frames movably mounted under the table top, leg stand members slidably supporting the triangular guide frames, and a driving apparatus fitted with the table top and operably connected to the triangular guide frame. The triangular guide frames are certainly held to the leg stand members to maintain the table top height by a finger screw or a clutch apparatus.

11 Claims, 8 Drawing Figures

DESK WITH HEIGHT AND ANGLE ADJUSTABLE TABLE TOP

BACKGROUND OF THE INVENTION

This invention relates to a metal desk, and more particularly to a metal desk, wherein the height and the angle of a table top can be adjusted and locked at an appropriate position.

In a conventional metal desk, wherein the height and the angle of a table top are adjustable, a driving a apparatus which actuates to move the table top upwardly or downwardly by a screw or a cylinder is vertically provided with a side plate or a pedetal which supports the table top, and other driving apparatus using particularly a screw for adjustment of the table top angle is separately disposed to the desk. And, a finger screw is used to lock the table top at an appropriate height due to screw fastening. An operation of vertical movement of the table top is made around the pedestal away from the table top, and the operation becomes complicate, and still more the table top is unstable and shaky on the pedestals. Therefore, durability of the metal desk reduces. Since the driving apparatus for adjustment of the table top angle is separately provided away from the other driving apparatus for adjustment of the table top height, it becomes expensive. In addition, the lock of the table top at the proper height is made of the finger screw, a threaded screw is defaced by use during long time, and locking effect of the table top becomes insufficient.

SUMMARY OF THE INVENTION

The present invention provides a new and more efficient metal desk. The metal desk of the present invention includes a table top which has a pair of side base plates thereunder, a pair of leg stands, and at least one driving apparatus which is disposed to the side base plate and is operably connected to the leg stand. The leg stand comprises a leg stand member which has an oblique sleeve member, and a triangular guide frame which is slidably disposed to the leg stand member. The triangular guide frame comprises an oblique member with a horizontal top projection, a horizontal member, and a supporting member pivotably and triangularly disposed between the oblique member and the horizontal member. The oblique member of the triangular guide frame which is formed of a plurality of rollers is slidably inserted in the oblique sleeve of the leg stand member. The table top is supported on the horizontal member of the triangular guide frame and is linked to the leg stand member by a supporting member with a pivotal pin. A lock apparatus of a finger screw or a clutch apparatus with a pedal apparatus is applied to the leg stand member to hold the triangular guide frame at the proper height of the table top.

When the table top is moved upward, the driving apparatus provided on the side base plate is operated to push the horizontal member of the triangular guide frame, accordingly the triangular guide frame moves obliquely upward along the oblique sleeve of the leg stand member, and the table top is smoothly moved upward along an arc of the pivotal pin within a limited range in accordance with movement of the triangular guide frame.

The driving apparatus does not return automatically without heavy weighting on the table top. Therefore, the table top maintains its height as it is. But, the lock apparatus is applied in order to secure the lock of the triangular guide frame and to prevent unexpected downward movement of the table top, namely the finger screw is fastened to the oblique member, or the clutch apparatus is engaged with a cutout of the oblique member by the pedal apparatus.

When the angle of the table top is changed, the driving apparatus is moved back slightly, namely the horizontal member of the triangular guide frame is slightly drawn to the front direction, and the table top is appropriately inclined with pivots.

When the table top is moved downward, the lock apparatus is released and the driving apparatus is operated to move back, namely, the horizontal member of the triangular guide frame is drawn to the front direction, and the triangular guide frame is moved obliquely along the oblique sleeve of the leg stand and the table top supported on the triangular guide frame is moved down.

Accordingly, an object of the present invention is to overcome the above disadvantages of the conventional desk by providing triangular guide frames to leg stands, and a driving apparatus to a table top operably connecting to the triangular guide frame.

Another object of the present invention is to provide a metal desk, wherein the height and the angle of a table top is adjustable by one driving apparatus.

A still another object is to provide a metal desk in which a table top can be maintained at a proper height by a lock apparatus of a finger screw or a clutch apparatus with a pedal.

A further object of the present invention is to provide a metal desk which has a simple construction and is easily operated to adjust the height and the angle of a table top.

A further object of the present invention is to provide a metal desk with a stably mounted table top which has simple constructions and is easily operated to adjust the height and the angle of the table top, and is manufactured at a low cost.

A still further object and many of the attendant advantages of the present invention will be readily appreciated as the same becomes better understood by reference to the following description when read in conjunction with the accompanying drawings.

BRIEF DESCRIPTION OF THE DRAWINGS

The accompanying drawings illustrate the preferred embodiments of the present invention.

Figure 1:
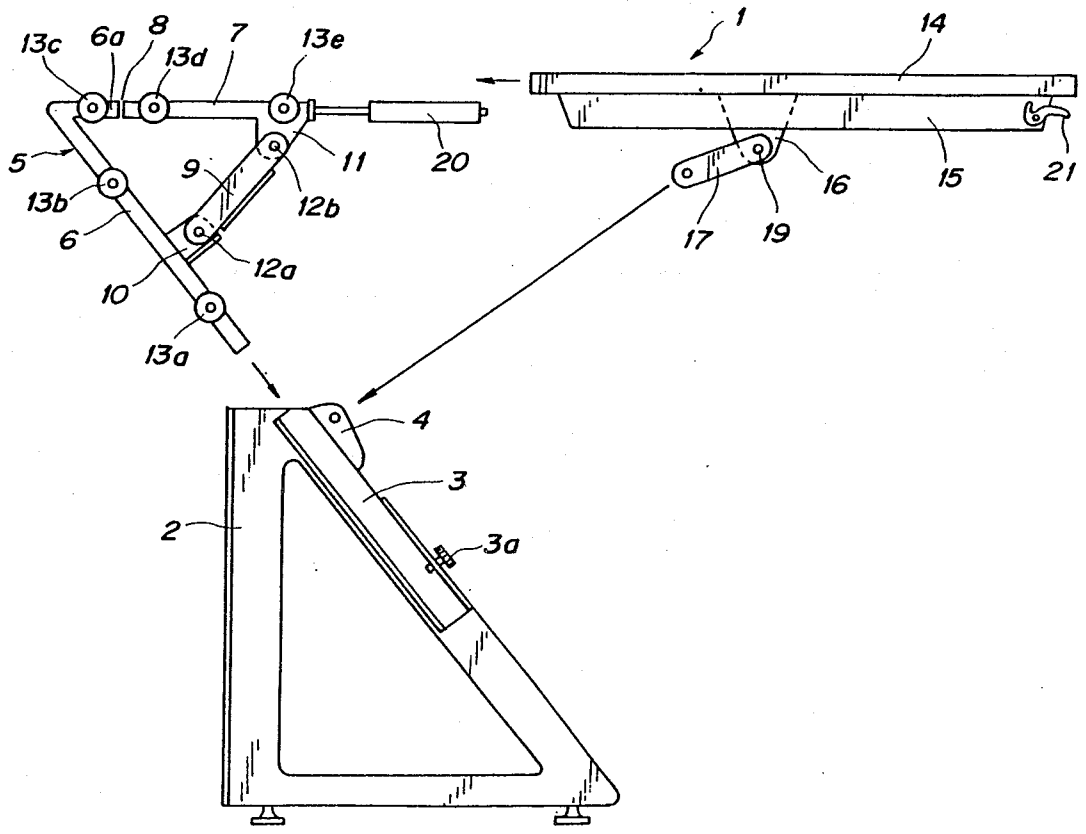
FIG. 1 is a partially sectional exploded side view of a metal desk in accordance with one embodiment of the present invention.
Figure 2:
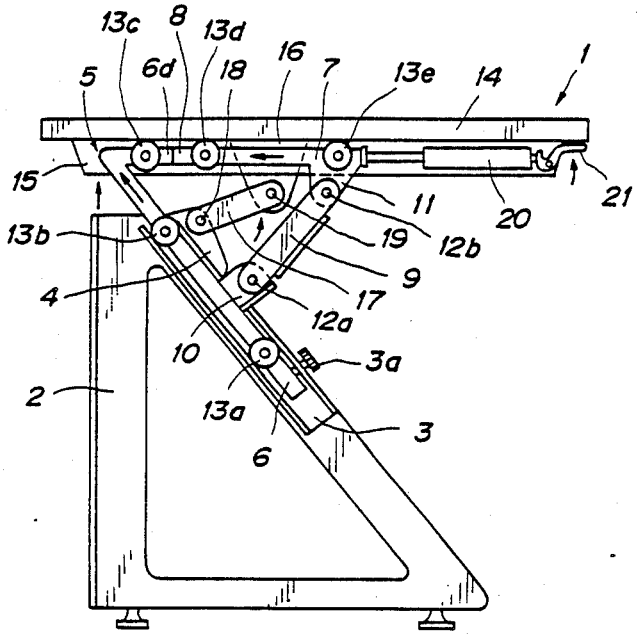
FIG. 2 is a side view of the metal desk showing a condition of upward movement of a table top of the desk.
Figure 3:
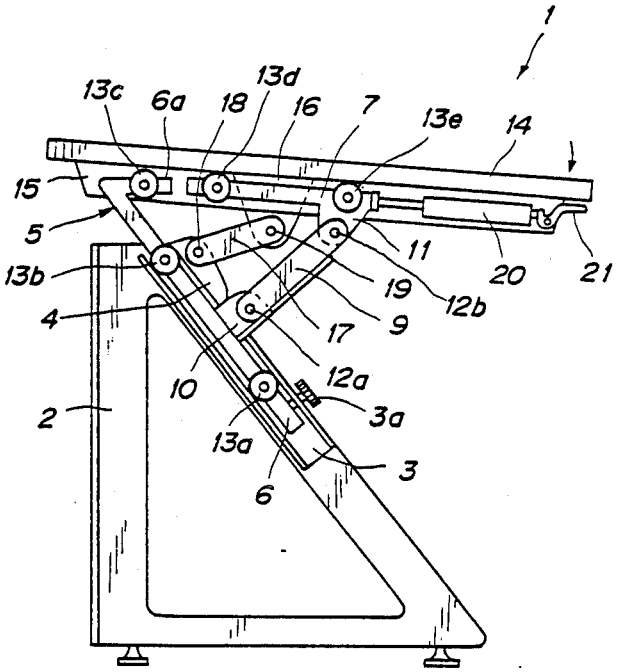
FIG. 3 is a side view of the metal desk showing other condition of adjustment of the table top angle.
Figure 4:
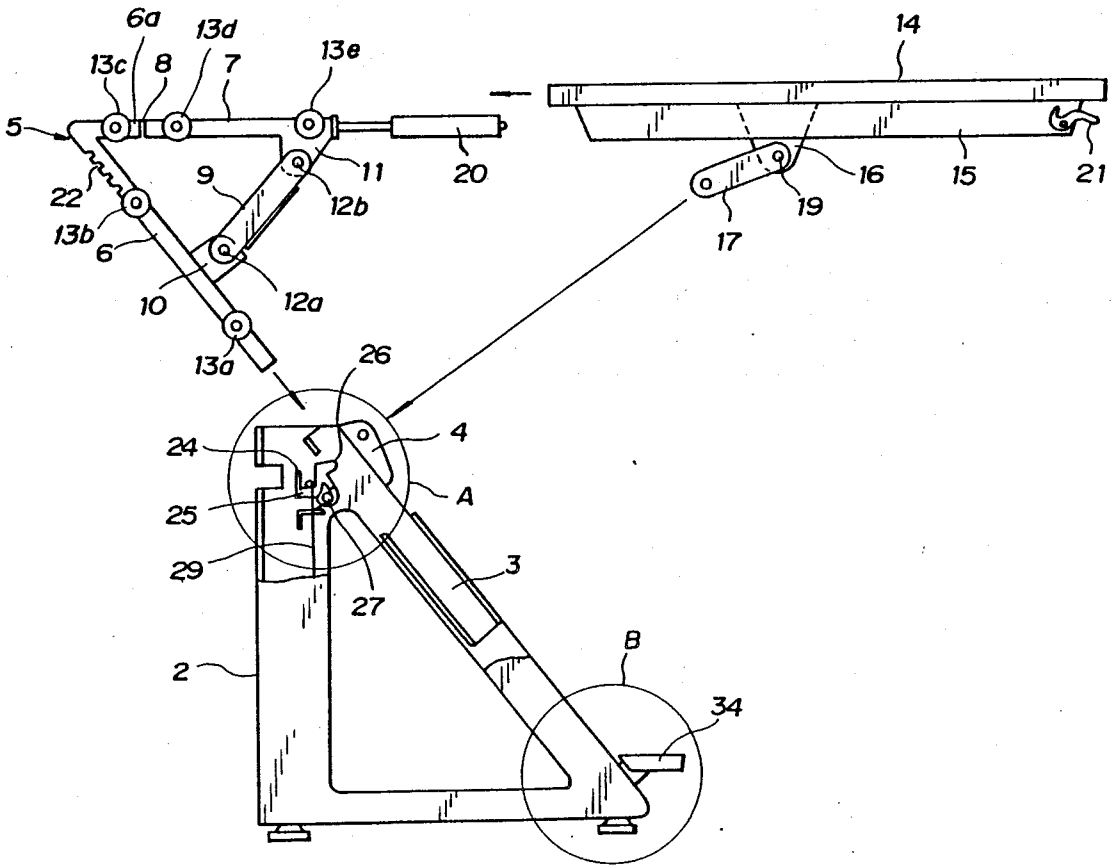
FIG. 4 is an exploded side view of a metal desk in accordance with other embodiment of the present invention.

Referring to the drawings, there is shown, according to preferred embodiments of the invention, in FIGS. 1, 2 and 3, a leg stand member 2 of a metal desk 1 which is triangularly formed by a metal frame material to have a central hollowed out triangular portion. A pair of the leg stand member 2 are vertically disposed under both sides of a table top 14 as a set of right and left coupled member. In this case, the both side leg stand members 2 are spaced, and are cnnected at an upper end portion by a level connection which is not shown in the drawings in a condition that a predetermined spaced is kept.

A sleeve 3 which is a square in a cross sectional view and has a longitudinal opening at an upper central portion is disposed parallel to and fixed in an oblique element of the leg stand member at the same angle. In the oblique sleeve 3, an oblique member 6 of a guide frame 5 is disposed movably upward and downward with rollers 13*a*, 13*b*. The guide frame 5 is triangularly constructed by the oblique member 6 with a horizontal top projection 6*a*, a horizontal member 7, and a supporting member 9. An aperture 8 is provided between ends of the horizontal top projection 6*a* and the horizontal member 7 which are detachably disposed. And, the oblique member 6 is formed to have a width to be received in the oblique sleeve member 3.

A projection 10 is provided at an intermediate portion of the oblique member 6 to pivotally connect a lower end of the supporting member 9 and to fixingly support it at a predetermined inclined angle. A horizontal top projection 6*a* of the oblique member 6 is placed at the same height of the horizontal member 7 and opposites to an end thereof. Between the both ends of the horizontal top projection 6*a* and the horizontal member 7, the aperture 8 is provided. A projection 11 is formed at the other end of the horizontal member 7 to pivotally connect an upper end of the supporting member 9.

The supporting member 9 has a length which corresponds to the distance between the intermediate projection 10 of the oblique member 6 and the end projection 11 of the horizontal member 7, and has a width to slide in the longitudinal opening of the oblique sleeve member 3. The supporting member 9 is pivotally connected to the respective projections 10, 11 by respective pins 12*a*, 12*b* which are inserted to the aligned holes provided in the projections 10, 11 and the supporting member 9. The supporting member 9 has a longitudinal front wall to limit inclined angle of the table top 14, rollers 13*a*, 13*b*, 13*c*, 13*d* and 13*e* are disposed on the oblique member 6, the horizontal top projection 6*a* and the horizontal member 7.

The table top 14 is mounted on the horizontal member 7 of the triangular guide frame 5 through the rollers of the horizontal top projection 6*a* and the horizontal member 7. A pair of side base plates 15 which are smaller than the table top 14 are fixed on a bottom of the table top 14. A supporting projection 16 which has a hole is mounted at an inside of an intermediate portion of the side base plate 15, and an upper end of a supporting member 17 which has a hole is pivotally mounted on the supporting projection 16 by a pivotal pin which is inserted in the aligned both holes thereof. A lower end of the supporting member 17 which has a hole is pivotally mounted on a supporting member which has a hole and is connected at an upper portion of the leg stand member 2, by a pivotal pin 18 as a same manner of the upper end pivotal connection.

When the table top 14 which is mounted on the triangular guide frame 5 moves upward, the table top 14 does not rise obliquely in along the oblique movement of the guide frame 5, and rises substantially just above as it is, because the table top 14 is pivotally connected to the leg stand member 2.

A driving apparatus 20 is constructed by a gas-spring device or the like. In a cylinder of the apparatus 20, the compressed gas or liquid gas is put in, and a piston goes ahead due to the pressure of the gas. A piston rod which is connected to the piston and is moved by the piston transfers movement of the piston to the triangular guide frame 5. The driving apparatus 20 is installed horizontally parallel to the table top 14 and on a front side portion of the side base plate 15 of the table top 14, and the piston rod is connected to an end of the horizontal member 7 of the triangular guide frame 5. Accordingly, when the driving apparatus 20 is operated, the triangular guide frame 5 moves obliquely along the oblique sleeve member 3 for an appropriate distance and until the table top 14 rises just above. A guide frame is disposed besides the side base plates 15 to cover the horizontal member 7 of the triangular guide frame and the driving apparatus 20.

A hand lever 21 is operably attached to an end of the driving apparatus 20 to operate the driving apparatus in accordance with pushing up of the hand lever by a finger. An interlocking axis which has pinions at both end is transversly disposed between the both side plates 15 under the table top 14 (not shown in the drawings), and a rack device is formed on an upper surface of each horizontal member 7 of the triangular guide frame 5 (not shown in the drawings). By engagement of the pinions and the rack devices, the triangular guide frames 5 at both sides of the table top 14 are simultaneously moved by one driving apparatus 20.

Generally the driving apparatus 20 does not return to a first condition and remains as it is unless strong opposite force is added to the driving apparatus. Therefore, the table top 14 does not fall unless very heavy weights are mounted thereon.

A finger screw 3*a* is disposed on the oblique sleeve member 3 to certainly fasten the oblique member 6 therein to maintain the appropriate table top height.

In other embodiment shown in the drawings from FIG. 4 to FIG. 8, the substantially same construction of the first embodiment is used. But, a plurality of cutout 22 is formed at an under surface of an upper portion of the oblique member 6 of the triangular guide frame 5, and an opening is provided at an upper portion of a bottom wall of the oblique sleeve member 3. And, a clutch apparatus which engages with the cutout 22 of the oblique member 6 through the opening of the oblique sleeve member 3 by an operation of a pedal member 34 is disposed.

Figure 5:
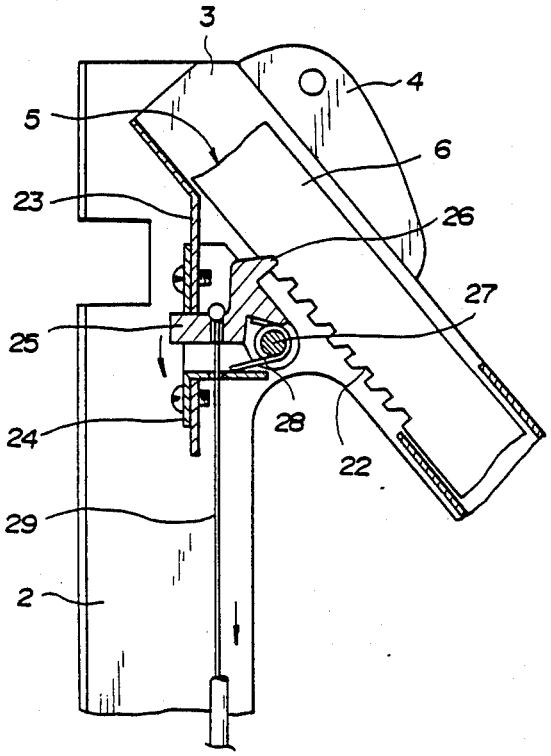
FIG. 5 is an enlarged vertical sectional view showing a clutch apparatus of the metal desk.
Figure 6:
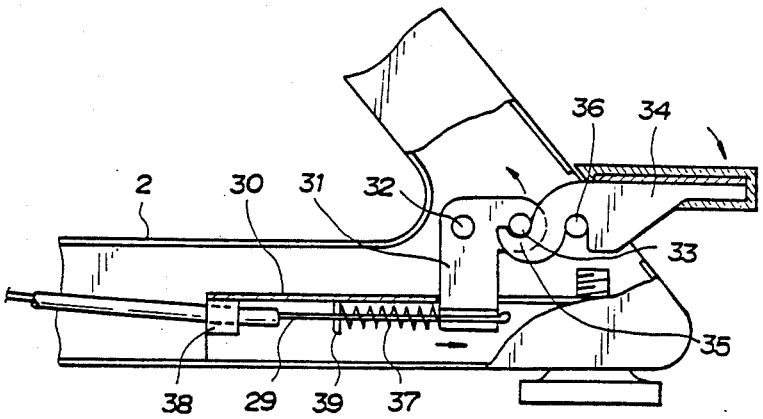
FIG. 6 is an enlarged vertical sectional view showing a pedal apparatus of the metal desk.
Figure 7:
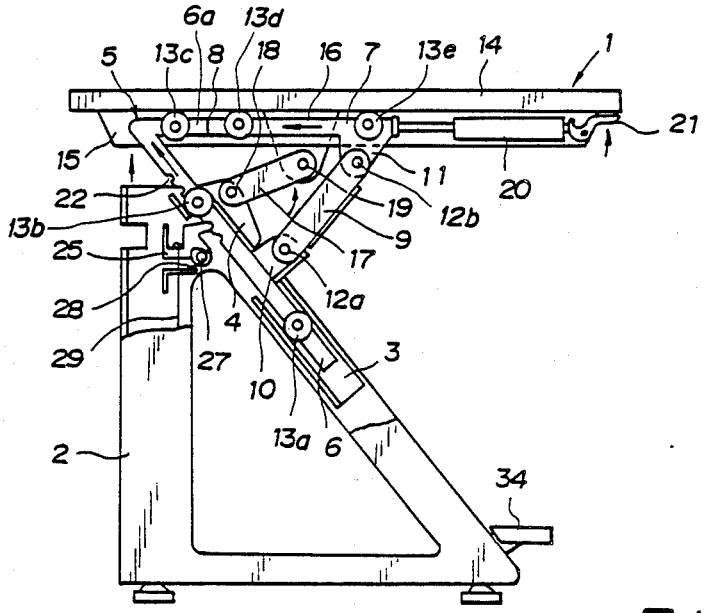
FIG. 7 is a side view of the metal desk showing a condition of upward movement of a table top of the desk.
Figure 8:
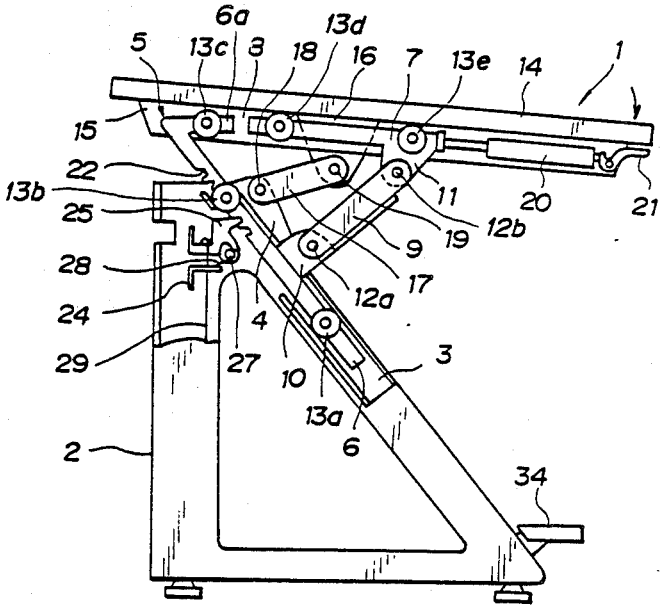
FIG. 8 is a side view of the metal desk showing other condition of adjustment of the table top angle.

As shown in FIGS. 5 and 6, a vertical plate 23 is connected to an upper portion of the bottom wall of the oblique sleeve member 3, and a clutch supporting plate 24 is fixed to the vertical plate 23 by threaded screws. An axis 27 is disposed at a front end portion of the clutch supporting plate 24, and a clutch member 25 which has a projection 26 at a front end portion is pivotally mounted on the axis 27. A spring 28 is provided on the axis 27, and the spring 28 pushes always the clutch member 25 to project the projection 26 through the opening of the oblique sleeve member 3 to the cutout 22 of the oblique member 6. An end of a wire 29 is connected to a rear end portion of the clutch member 25 in a condition that the wire 29 is pulled by the pedal member 34 and to pivotally move the clutch member 25 around the axis 27 by the pull of the wire 29.

The wire 29 extends to the pedal member 34, wherein an end of the wire 29 is connected to a pivotal linkage member 31 which is pivotally mounted by a pivotal axis 32 to a lower end of the leg stand member 2 adjacent to the pedal member 34. The pivotal linkage member 31 is pushed to the direction that the wire 29 is tensioned by a pedal spring 39 which is disposed between the member 31 and a supporting member 39 fixed to a supporting plate 30 provided to the leg stand member 2. The wire 29 is protected by a tube or the like which is held by a cramp member 38 provided on the supporting plate 30. A pin 33 is transversely projected from a side wall of the pivotal linkage member 31, and a supporting axis 36 is transversely projected adjacent and parallel to the pin 33 from a lower portion of the leg stand member 2. An opening is formed at a front lower portion of the leg stand member 2 through which the pedal member 34 which has recesses is inserted. A tip end recess 35 of the pedal member 34 is engaged with the pin 33 to turn upward and other rear recess of the pedal member 34 is engaged with the supporting axis 36 around which the pedal member 34 is moved.

When the pedal member 34 is treaded downward, the tip end of the pedal member 34 moves upward as shown by arrow heads in FIG. 6. The pivotal linkage member 31 is pivotally moved by the pedal member along the movement of the tip end thereof, and the wire 39 is pulled by the pivotal linkage member 31 as shown by arrow heads in FIG. 6. When the wire 39 is pulled, the clutch member 25 is pivotally moved around the axis 27 by the pull operation of the wire 29 as shown by arrow heads in FIG. 5. In accordance with the pivotal movement of the clutch member 25, the tip projection 26 releases the oblique member 6 from the engagement therewith, and the oblique member 6 slides freely upward or downward along the oblique sleeve member 3. When the pedal member 34 is not treaded, the clutch member 25 is urged to engage with the cutout of the oblique member 6 by the spring 28.

With regard to the operation of the metal desk of the present invention, firstly, the finger screw **3*a* in the first embodiment is released from the oblique member 6 of the triangular guide frame 5. The pedal member 34 in the second embodiment is treated down and the clutch apparatus is released from the cutout of the oblique member 6. Secondly, the hand lever 21 of the driving apparatus 20 is pushed up to operate the driving apparatus 20. By this operation, the piston in the cylinder of the driving apparatus 20 is pushed forwardly due to the compressed gas. Along the forward movement of the piston, the piston rod which is connected to the horizontal member 7 of the triangular guide frame 5 is pushed rearward under the table top 14. At this time, the triangular guide frame 5 is obliquely and upward moved with the rollers along the oblique sleeve member 3, and simultaneously the table top 14 rises vertically operably with the supporting member 17 in accordance with the obliquely rising movement of the triangular guide frame 5. When the table top 14 reaches at an appropriate height, the hand lever 21 is released and the operation of the driving apparatus 20 is stopped. At this time, in the first embodiment the finger screw 3*a* is fastened to the oblique member 6 through the oblique sleeve member 3, and in the second embodiment, the pedal member is released from treading thereof and the clutch apparatus is engaged with the cutout 22 of the oblique member 6 for certain fixation of the oblique member 6 to the leg stand member 2 through the sleeve 3 and for maintenance of the table top height. In this condition, the triangular guide frame 5 and the supporting member 9** form a certain right triangular relationship.

When the angle of the table top 14 is changed, namely, the table top 14 is inclined, the hand lever 21 is slightly pushed upward and simultaneously the driving apparatus 20 is reversely operated with pushing down the front portion of the table top. By the slightly reverse operation of the driving apparatus 20, the horizontal member 7 is pulled and is pivotally moved around the pin **12*b* and tip portion of the horizontal member 7 rises and the horizontal member 7 is inclined upon breakdown of the right triangular relationship of the triangular guide frame and the supporting member 9, since the oblique member 6 of the triangular guide frame 5 is fixed to the oblique sleeve member 3 and does not move despite the pushing down of the front portion of the table top 14. When the table top 14 is inclined at an appropriate angle, pressure applied to the table top 14** is stopped to maintain its inclined condition.

When the table top 14 is fallen, in the first embodiment the finger screw **3*a* is released from fastening of the oblique member 6 with the oblique sleeve member 3, and in the second embodiment the pedal member 34 is treaded down and the clutch apparatus is released from the cutout of the oblique member of the triangular guide frame 5. And, the hand lever 21 is push up and the driving apparatus 20 is released, and simultaneously the table top 14 is pushed down to an appropriate table top height in opposition to the compressed gas in the cylinder of the driving apparatus 20. When the table top 14 is in the lowest portion, it is not necessary to fasten the oblique member 6 to the oblique sleeve member 3**.

In the metal desk of the present invention, it is possible to dispose each driving apparatus 20 on each side base plate of the table top and to connected it respectively to each triangular guide frame disposed to the each leg stand member.

As explained above, the metal desk of the present invention has a pair of unique formed triangular guide frames and fastening apparatus of the guide frame. And the triangular guide frame is connected to at least one driving apparatus which is used to change the table top height and angle. Therefore, the table top moves stably upward and downward, and changes its angle at any height with the driving apparatus by the slight force. And the triangular guide frame has a plurality of roller which effect to smoothly move in the oblique sleeve member and under the table top, therefore, it is possible not to damage the oblique member the triangular guide frame. The table top height is certainly maintained by the finger screw or the clutch apparatus. The driving apparatus is used to both purpose of the adjustment of the height and angle of the table top, therefore, it is reduced the costs for manufacture of the metal desk, and the stability and quality of the metal desk is increased.

The invention may be embodied in other specific forms without departing from its spirit or essential characteristics. The described embodiment is to be considered in all respects only as illustrative and not limiting, and the scope of the invention is, therefore, indicated by the appendant claims rather than by the foregoing description. All changes which come within the meaning and range of equivalency of the claims are to be considered within their scope. Consequently, it is recognized that many variations may be made without departing from the scope or spirit of the present invention.

I claim:

1. A desk with height and angle adjustable table top comprising;

a stand device adapted to be situated on a floor and having at least one sleeve member attached to the stand device to extend obliquely upwardly, at least one guide frame including an oblique member slidably situated in the sleeve member and having an upper portion, a horizontal member having a first end situated adjacent to the upper portion of the oblique member and a second end opposite the first end, and a supporting device pivotally connected to the oblique member and the horizontal member so that the horizontal member can be moved between a horizontal position and a tilted position relative to the floor, a table top substantially slidably situated on the horizontal member of the guide frame, at least one driving apparatus connected between the table top and the horizontal member of the guide frame, said driving apparatus having a switch so that when the switch is actuated, the driving apparatus pushes the horizontal member horizontally relative to the table top, at least one connecting device situated between the table top and the stand device so that when the driving apparatus is actuated, the guide frame is moved obliquely upwardly along the sleeve member and the table top is substantially vertically upwardly moved relative to the stand device while laterally sliding on the horizontal member of the guide frame as the guide frame moves obliquely, and a fastening device for locking the oblique member relative to the stand device, so that when the table top is pushed obliquely downwardly while the fastening device and the switch of the driving apparatus are actuated, the table top tilts.

2. A desk according to claim 1, in which said connecting device comprises an upper supporting projection provided beneath the table top, a lower supporting projection provided on the stand device, and a link pivotally connected to the upper and lower supporting projections.

3. A desk according to claim 2, in which said oblique member is provided with a projection at the upper portion thereof, said projection extending toward the horizontal member so that when the projection is pushed horizontally by the driving apparatus, the oblique member is urged to move obliquely upwardly.

4. A desk according to claim 3, in which said driving apparatus includes a body connected to the table top a rod slidably situated in the body, and connected to the horizontal member, and means for urging the rod away from the body situated in the body, said rod being urged toward the projection by the urging means only when the switch is actuated.

5. A desk according to claim 4, in which said guide frame further includes a plurality of rollers mounted on the oblique member and the horizontal member so that the oblique member and the horizontal member can smoothly slide relative to the sleeve member and the table top.

6. A desk according to claim 5, in which said stand device comprises two leg stand members having the sleeve members respectively, said guide frames being provided on the respective sleeves so that the table top is supported by the two guide frames.

7. A desk according to claim 6, in which said fastening device is a finger screw mounted on the sleeve member.

8. A desk according to claim 1, in which said fastening device comprises a plurality of cutouts formed on the oblique member, a clutch member situated on the stand device, said clutch member being urged toward the cutouts so that the clutch member engages the cutouts to prevent movement of the oblique member relative to the stand device, and an operating device mounted on the stand device and operationally connected to the clutch so that when the operating device is actuated, the clutch member is disengaged from the cutouts to allow the oblique member to move relative to the stand device.

9. A desk according to claim 8, in which said clutch member includes a projection at an end of the clutch member to engage the cutouts.

10. A desk according to claim 9, in which said fastening device further includes a spring attached to the clutch member to allow the projection of the clutch member to engage the cutouts.

11. A desk according to claim 10, in which said operating device comprises a pedal pivotally connected to the stand device, a link pivotally connected to the stand device and engaging the pedal, and a wire situated between the clutch member and the link so that when the pedal is actuated, the projection of the clutch member disengages from the cutouts.

* * * * *